US006428111B1

(12) United States Patent
Kammerer

(10) Patent No.: US 6,428,111 B1
(45) Date of Patent: Aug. 6, 2002

(54) ROUND-SHAFT CUTTER

(75) Inventor: Karl Kammerer, Fluorn-Winzeln (DE)

(73) Assignee: Betek Bergbau-und Hartemtalltechnik Karl-Heinz Simon GmbH & Co. KG, Aichhalden (DE)

( * ) Notice: Subject to any disclaimer, the term of this patent is extended or adjusted under 35 U.S.C. 154(b) by 0 days.

(21) Appl. No.: 09/571,045

(22) Filed: May 15, 2000

(30) Foreign Application Priority Data

May 14, 1999 (DE) ..... 199 22 208

(51) Int. Cl.[7] ..... E21C 35/183
(52) U.S. Cl. ..... 299/113; 299/111; 299/105
(58) Field of Search ..... 299/105, 106, 299/110, 111, 112, 113; 175/331

(56) References Cited

U.S. PATENT DOCUMENTS 6,270,165 B1 * 8/2001 Peay ..... 299/111

FOREIGN PATENT DOCUMENTS

| | | | | |
|---|---|---|---|---|
| DE | 37 01 905 C1 | | 9/1988 | |
| GB | 2146058 A | * | 4/1985 | ..... 299/111 |
| SU | 0717327 A | * | 2/1980 | ..... 299/111 |
| WO | WO-8400987 A1 | * | 3/1984 | ..... 299/111 |

* cited by examiner

*Primary Examiner*—David Bagnell
*Assistant Examiner*—Daniel P Stephenson
(74) *Attorney, Agent, or Firm*—Pauley Petersen Kinne & Erickson

(57) ABSTRACT

A round-shaft cutter with a cutter head and a cutter shaft, wherein the cutter head has a cutter tip which is inserted with a base element into a receiver of the cutter head and is there fixed in place. To increase the wear resistance of the round-shaft cutter, a recess is cut into the cutter head in an area of the receiver below the base element of the cutter tip. A wear-protection element is inserted into the recess and is there fixed in place.

8 Claims, 1 Drawing Sheet

ROUND-SHAFT CUTTER

BACKGROUND OF THE INVENTION

1. Field of the Invention

This invention relates to a round-shaft cutter with a cutter head and a cutter shaft, wherein the cutter head has a cutter tip which is inserted with a base element into a receiver of the cutter head and is there fixed in place.

2. Description of Related Art

A conventional round-shaft cutter is known from German Letters Patent 37 01 905.8-09. The base cutter body made of steel has a receiver for the hard alloy cutter tip in the area of the cutter head. The cutter tip is soldered into the receiver. Such a round-shaft cutter is used, for example, for cutting road surfaces. Individual cutter tips can break out of their receivers, in particular when working very hard road surfaces. Thus, the cutter head of the base cutter body, which has a much softer material than the cutter tip, is rapidly ground down. The round-shaft cutter, however, is seated in a cutter holder. If the cutter head is now ground down, the cutter holder is damaged. This requires cost-intensive repairs.

SUMMARY OF THE INVENTION

It is one object of this invention to provide a round-shaft cutter of the type previously mentioned, which is distinguished by good wear resistance.

This object is achieved with a recess cut into the cutter head in an area of the receiver below the base element of the cutter tip. A wear-protection element is there inserted into the recess and fixed in place.

If the cutter tip of the round-shaft cutter breaks off because of high stress, the additional wear-protection element assures an emergency operating capability until the following tool change. Accordingly, the wear-protection element prevents the rapid wear of the cutter head, so that the cutter holder is protected.

The round-shaft cutter in accordance with this invention also has advantages where the tool change takes place, past the longest permissible length of use. In this case, with the cutter tip worn down, the wear-protection element protects the cutter holder over a defined transition time.

According to one preferred embodiment of this invention, the receiver for the cutter tip and the recess are designed dynamically balanced with respect to the axis of rotation of the round-shaft cutter. The rotatory properties of the round-shaft cutter are not affected because of the symmetrical design of the cutter.

In one embodiment of this invention the cutter can for example be constructed so that the receiver is cut in a plate shape into the cutter head and has a support surface for the cutter tip which extends vertically with respect to the axis of rotation of the round-shaft cutter. The recess is cut into the support surface and the wear-protection element ends flush with the support surface.

However, it is also conceivable that the wear-protection element rises with a projection above the cutter head in the direction of the axis of rotation of the round-shaft cutter. The cutter tip has a depression into which the projection extends. In this case the projection of the wear-protection element also absorbs transverse forces acting on the cutter tip, crosswise with respect to the axis of rotation of the cutter tip. This aids the fastening of the cutter tip on the cutter head.

For simplifying the assembly, on an end of the wear protection element facing away from the cutter tip the wear-protection element has a bevel-like taper.

A round-shaft cutter in accordance with this invention can be designed so that the wear-protection element is made of a hard alloy and is soldered into the recess.

BRIEF DESCRIPTION OF THE DRAWINGS

This invention will be explained in greater detail in what follows by exemplary embodiments represented in the drawings, wherein.

DESCRIPTION OF PREFERRED EMBODIMENTS

Figure 1:
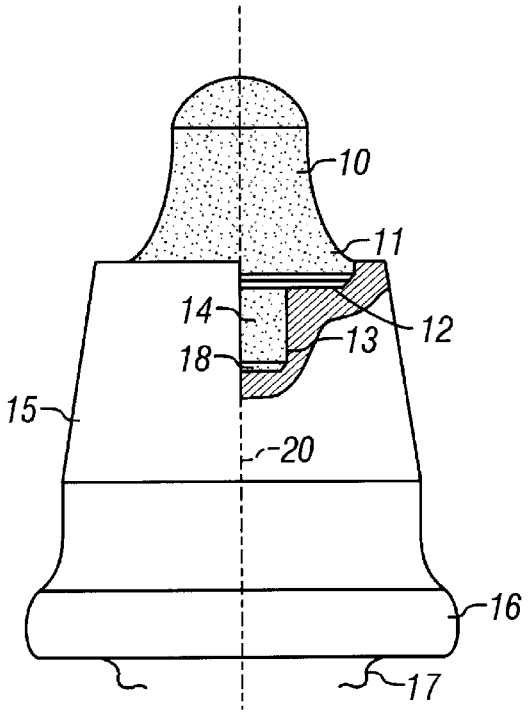
FIG. 1 shows a partial sectional side view of a round-shaft cutter with a cutter tip.

FIG. 1 shows a section of a round-shaft cutter with a cutter shaft 17 and a cutter head 15. The basic cutter body includes the cutter shaft 17 and the cutter head 15 which is preferably made of steel, for example tempered steel. The cutter head 15 has a collar 16 for contact with a cutter holder, not shown in the drawings. In the area facing away from the collar 16, a plate-shaped receiver 12 is cut into the cutter head 15. The receiver has a flat support surface, to which a circumferential edge is connected. The support surface extends vertically with respect to the axis of rotation 20 of the round-shaft cutter. A cylindrical recess 13 is cut into the support surface of the receiver 12. The receiver 12 and the recess 13 can be dynamically balanced with respect to the axis of rotation 20.

A cylindrical wear-protection element 14 constructed of a hard alloy can be inserted and soldered into the recess 13. The wear-protection element 14 has a bevel-like taper 18 for making assembly easier. This simplifies threading of the wear-protection element 14 into the recess 13. The end of the wear-protection element 14 facing away from the taper 18 is embodied flat and terminates level with the support surface of the receiver 12.

A cutter tip 10 is inserted with the base element 11 into the receiver 12 and can be soldered in place. In this case an underside of the cutter tip 10 rests on the flat surface of the wear-protection element 14.

Figure 2:
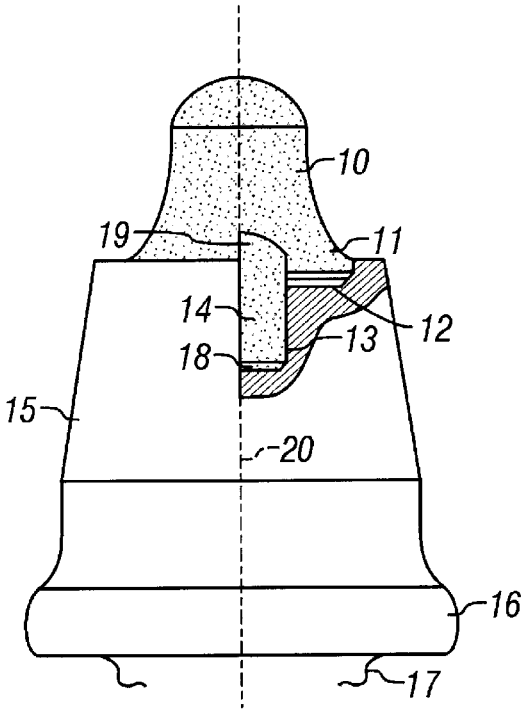
FIG. 2 shows a partial sectional side view of a round-shaft cutter with a cutter tip modified with respect to the embodiment shown in FIG. 1.

A modified embodiment variation of a round-shaft cutter is represented in FIG. 2. As shown, the wear-protection element 14 protrudes past the support surface of the receiver 12 with a projection 19. The protruding end of the wear-protection element 14 is concavely rounded. In the area of its base element 11, the cutter tip 10 has a depression formed on the projection 19. When the cutter tip 10 is inserted into the receiver 12, the projection 19 extends into this depression. The concavely-shaped form of the projection 19 makes the cutter tip mounting easier.

What is claimed is:

1. In a round-shaft cutter with a cutter head and a cutter shaft, wherein the cutter head has a cutter tip with a base element fixed into a receiver of the cutter head, the improvement comprising:

the cutter head (15) having a recess (13) in an area of the receiver (12) below the base element (11) of the cutter tip (10);

a wear-protection element (14) fixedly inserted into the recess (13); and the receiver (12) cut in a plate shape into the cutter head (15) and having a support surface for the cutter tip (10)

which extends vertically with respect to an axis of rotation of the round-shaft cutter, the recess (13) cut into the support surface, and the wear-protection element (14) ending flush with the support surface.

2. The round-shaft cutter in accordance with claim 1, wherein the receiver (12) for the cutter tip (10) and the recess (13) are dynamically balanced with respect to an axis of rotation of the round-shaft cutter.

3. The round-shaft cutter in accordance with claim 2, wherein the wear-protection element (14) rises with a projection (19) above the cutter head (15) in a direction of the axis of rotation of the round-shaft cutter, and the cutter tip (10) has a depression into which the projection (19) extends.

4. The round-shaft cutter in accordance with claim 3, wherein on an end facing away from the cutter tip (10) the wear-protection element (14) has a bevel-like taper (18).

5. The round-shaft cutter in accordance with claim 4, wherein the wear-protection element (14) is constructed of a hard alloy and is soldered into the recess (13).

6. The round-shaft cutter in accordance with claim 1, wherein the wear-protection element (14) rises with a projection (19) above the cutter head (15) in a direction of an axis of rotation of the round-shaft cutter, and the cutter tip (10) has a depression into which the projection (19) extends.

7. The round-shaft cutter in accordance with claim 1, wherein on an end facing away from the cutter tip (10) the wear-protection element (14) has a bevel-like taper (18).

8. The round-shaft cutter in accordance with claim 1, wherein the wear-protection element (14) is constructed of a hard alloy and is soldered into the recess (13).

* * * * *